US005346454A

United States Patent [19]

Hayashi

[11] Patent Number: 5,346,454

[45] Date of Patent: Sep. 13, 1994

[54] TURRET PUNCH PRESS

[75] Inventor: Tetsuji Hayashi, La Mirada, Calif.

[73] Assignee: Amada Manufacturing America, Inc., LaMirada, Calif.

[21] Appl. No.: 6,941

[22] Filed: Jan. 21, 1993

[51] Int. Cl.[5] ..... B23Q 3/155

[52] U.S. Cl. ..... 483/29; 72/446; 83/552

[58] Field of Search ..... 483/28, 29; 83/552, 83/563; 72/441, 442

[56] References Cited

U.S. PATENT DOCUMENTS 3,745,646 7/1973 Kristiansson ..... 483/29

5,215,513 6/1993 Maynard et al. ..... 483/29

*Primary Examiner*—Z. R. Bilinsky

*Attorney, Agent, or Firm*—Wigman, Cohen, Leitner & Myers

[57] ABSTRACT

A turret punch press (1) includes an upper turret (5) for holding punches (P) and a lower turret (7) for holding dies (D). The diameter of the lower turret (7) is larger than that of the upper turret (5) so that a punch exchange position (61) and a die exchange position (61), which are opposite to a punching position (21), are separated away from each other. This arrangement enables the die to be exchanged from above the same, expands the freedom of designing of dies, improves workability, and realizes an automatic die exchange in an automatic index station.

18 Claims, 8 Drawing Sheets

TURRET PUNCH PRESS

BACKGROUND OF THE INVENTION

1. Field of the Invention

The present invention relates to a turret punch press having upper and lower turrets for holding a plurality of punches and dies each for performing punching in a plate workpiece.

2. Prior Art

A turret punch press generally includes an upper turret for holding punches and a lower turret for holding dies. The upper and lower turrets are vertically disposed to face each other with a certain gap therebetween and are synchronously turned to locate a required pair of punch and die at a punching position under a striker.

In order to exchange the dies on the turrets, the dies must be transferred through the gap between the upper and lower turrets which is usually very small. Accordingly, the maximum height of the die is limited by the width of the gap. Furthermore, in a conventional turret punch press, it is difficult to exchange the dies on an automatic index station since the dies on the automatic index station are held in rotary holders; in other words, in order to exchange the dies on the automatic index station, a suitable die passage must be provided in the side wall of the rotary holders.

SUMMARY OF THE INVENTION

To solve these problems, an object of the present invention is to provide a turret punch press that allows dies to be exchanged from above the turrets, expands the designing freedom of dies, improves workability, and realizes an automatic exchange of dies in an automatic index station.

In order to accomplish the above object, the present invention provides a turret punch press having upper and lower rotary turrets for holding punches and dies, respectively, wherein the diameter of the lower turret is larger than that of the upper turret so that a punch exchange position and a die exchange position are horizontally separated away from each other. The punch exchange position and the die exchange position are preferably located across the turrets from a punching position under the striker.

Another turret punch press according to the present invention has upper and lower rotary turrets for holding punches and dies respectively, with the axis of one of the upper and lower turrets being horizontally movable relative to the other so that the punch and die exchange positions can be horizontally separated from each other.

In this way, a turret punch press according to the present invention employs upper and lower turrets having different diameters, or with the axis of rotation of one of the turrets being movable relative to each other. Thus, the punch exchange position of the upper turret can be separated away from the die exchange position of the lower turret. As a result, a die at the die exchange position on the lower turret can be exchanged from above the lower turret.

These and other objects, features and advantages of the present invention will be more apparent from the following detailed description of preferred embodiments in conjunction with the accompanying drawings.

DETAILED DESCRIPTION OF THE EMBODIMENTS

Figure 1:
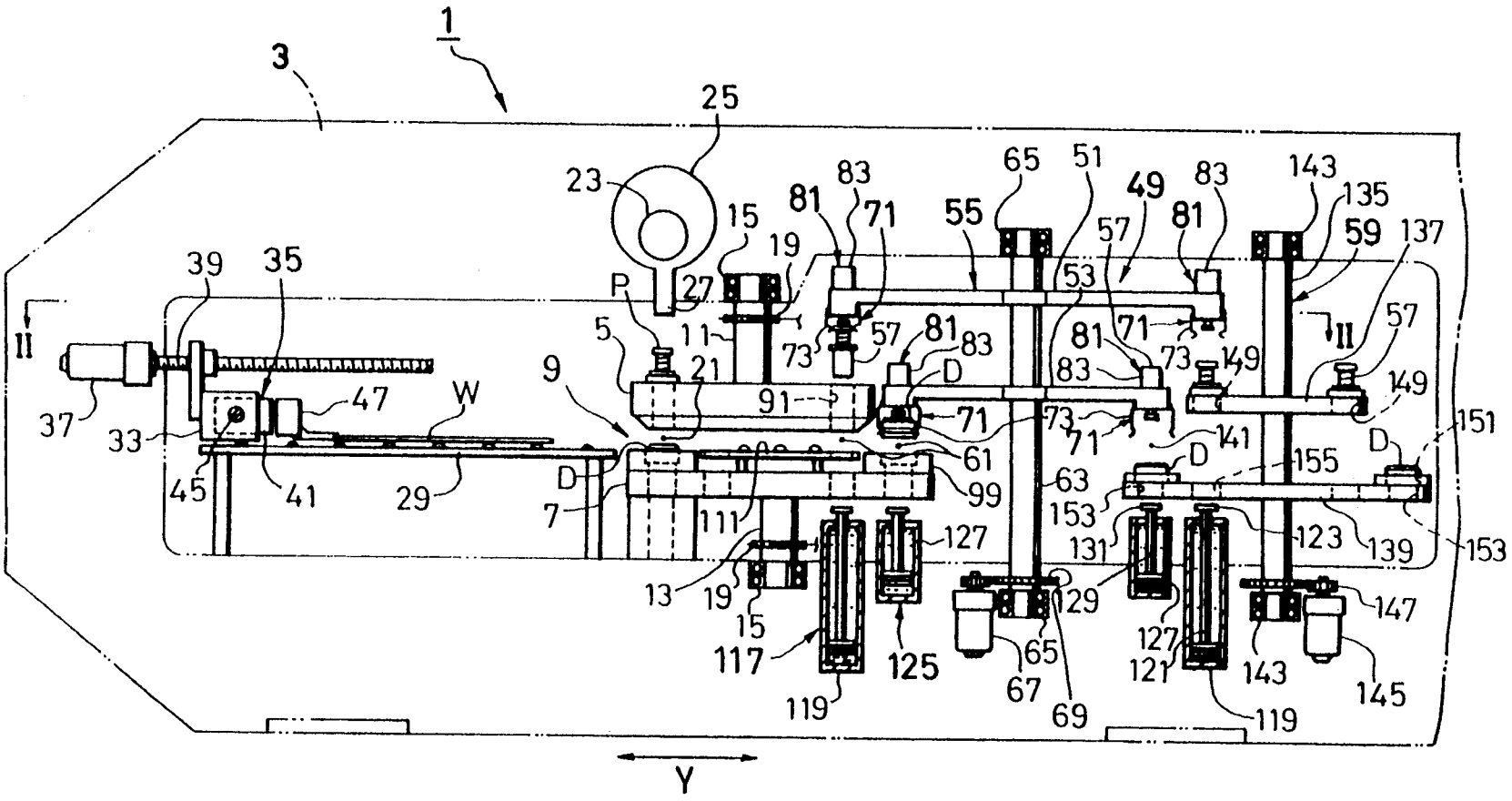
FIG. 1 is a partly sectioned side view showing the first embodiment of a turret punch press according to the present invention.
Figure 2:
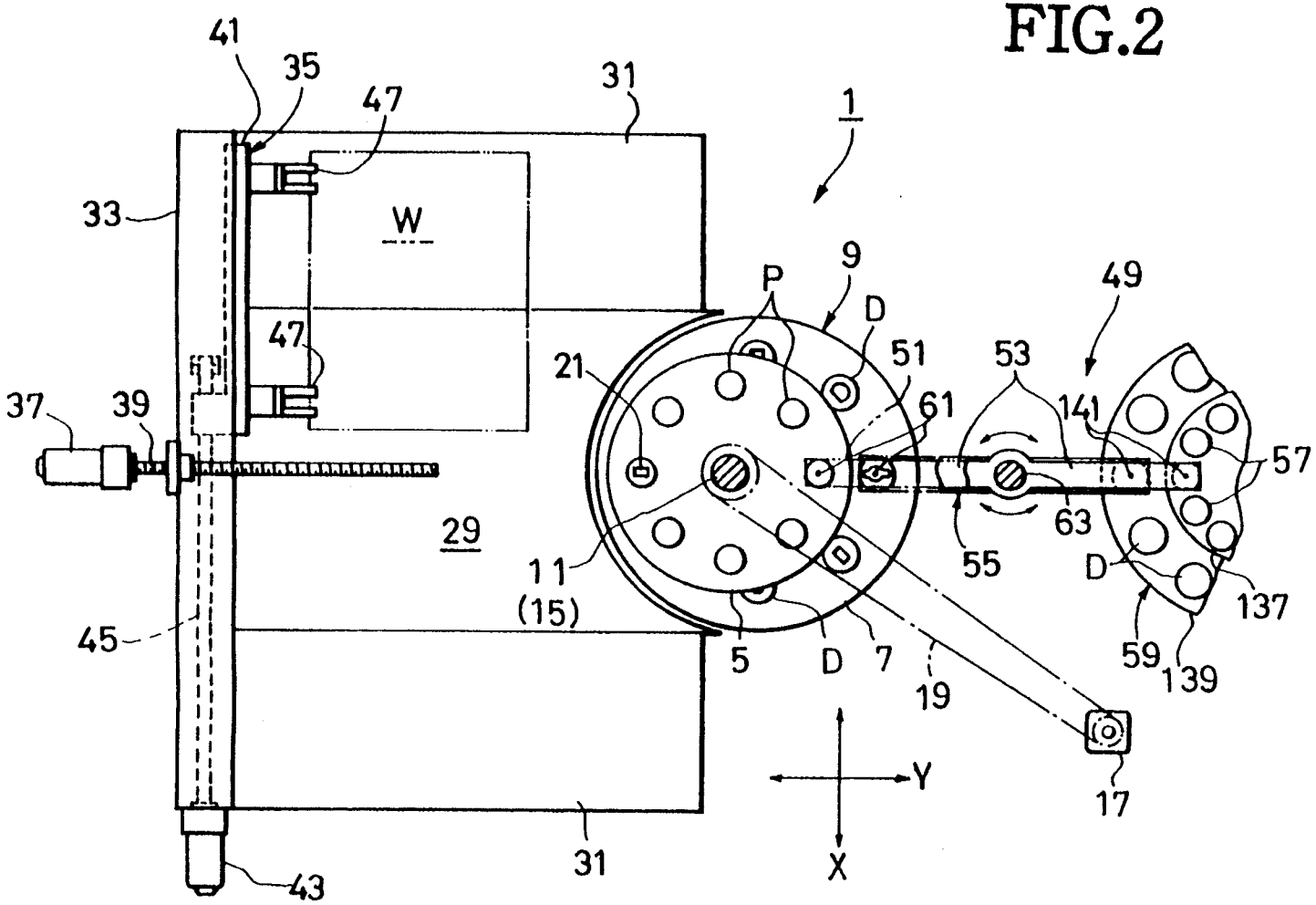
FIG. 2 is an enlarged plane view taken along a line II—II of FIG. 1.

FIGS. 1 and 2 show the first embodiment of the turret punch press according to the present invention.

The turret punch press 1 has a gantry frame 3. Disposed at the center of the frame 3 are turrets 9 which includes upper and lower rotary turrets 5, 7. The diameter of the lower turret 7 is larger than that of the upper turret 5.

Punches P and dies D are disposed along the peripheries of the upper turret 5 and the lower turret 7, respectively. A rotary shaft 11 integral with the upper turret 5 is supported by the frame 3 through an upper bearing 15, and a rotary shaft 13 integral with the lower turret 7 is supported by the frame 3 through a lower bearing 15. As best shown in FIG. 2, to turn the upper an lower turrets 5 and 7, a pair of motors 17 and a pair of torque transmission members 19 such as chains are provided; each member 19 is stretched around respective motor 17 and respective rotary shaft 11 or 13.

Provided on the left side of the turrets 9 as viewed in FIGS. 1 and 2 is a punching position 21 where punching is performed. A punch-and-die pair P, D attached to the upper and lower turrets 5, 7 are simultaneously positioned at the punching position 21. As shown in FIG. 1, to strike a punch P at the punching position 21, a crankshaft 23 driven by a suitable motor (not shown) is rotatably provided on the frame 3. Specifically, the crankshaft 23 drives a striker 27 through a connecting rod 25 so that the striker 27 strikes the punch P at the punching position 21. As a result, the punch P and die D cooperate to perform a punching in a workpiece W. Here, the striker 27 may be driven by a suitable hydraulic cylinder.

Referring again to FIGS. 1 and 2, a center table 29 is arranged at lower part of the frame 3. A movable table 31 is arranged on each side of the center table 29 so as to be movable along the axis Y extending in a left-to-right direction in FIGS. 1 and 2. Guides (not shown) are suitably provided for guiding the movement of the tables 31 along the axis Y. Secured to the left ends of the movable tables 31 as viewed in FIGS. 1 and 2 is carriage base 33 extending along the axis X perpendicular to the axis Y. The carriage base 33 slidably supports a carriage 41 for sliding along the axis X. The carriage 41 is provided with a pair of clamps 47 for holding the workpiece W. In order to move the movable table 31 and the carriage base 33 along the axis Y, a servo motor 37 is provided for driving a ball screw 39 that engages with a nut (not shown) mounted on the movable table 31. Further, in order to move the carriage 41 along the axis X, a servo motor 43 is provided for driving a ball screw 45 that engages with a nut (not shown) mounted on the carriage 41.

In this way, the movable table 31, the carriage base 33, and carriage 41 constitutes a work positioner 35. That is to say, by moving the carriage base 33 along the axis Y and the carriage 41 along the axis X, a required section on the workpiece W held by the clamps 47 is brought to the punching position 21 under the striker 27.

As best shown in FIG. 1, a punch and die changer 49 is provided on the right side of the upper and lower turrets 5 and 7 as viewed in the FIG. 1. The punch and die changer 49 includes a tool changer 55 and a tool magazine 59. The tool changer 55 has a pair of long punch changer arms 51 and a pair of short die changer arms 53, the arms of each pair being mounted on a shaft 63 in such a way as to protrude from a shaft 63 in the opposite directions. The tool magazine 59 is adapted to store the punch sets 57 and the dies D. Here, it is to be noted that the punch set 57 includes the punch P which is housed in the punch set 57.

Specifically, as shown in FIGS. 1 and 2, there are provided a first punch exchange position 61 and a first die exchange position 61 where the punches P and dies D are exchanged between the turrets 9 and the tool changer 55. In this embodiment, the a first punch exchange position 61 and a first die exchange position 61 are located across the turrets 5, 7 from the punching position 21. The upper and lower turrets 5, 7 have different diameters so as to create a horizontal positional difference between the first punch exchange position 61 and the first die exchange position 61. It is to be noted that the tool changer 55 is provided in a position adjacent to the first tool exchange positions 61.

Figure 3:
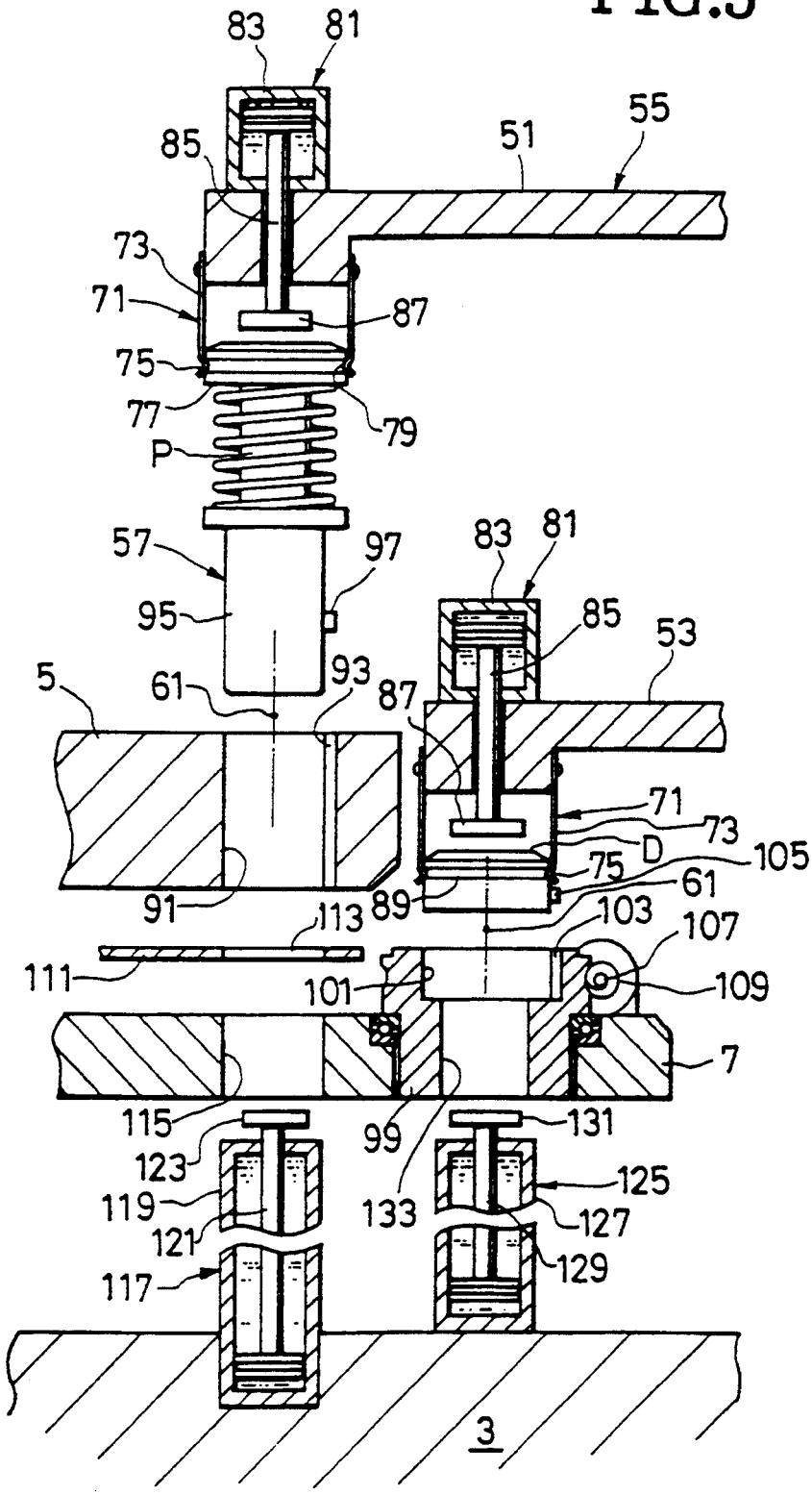
FIG. 3 is an enlarged side section showing a tool changer provided in the first embodiment of the turret punch press.

The tool changer 55 has the support shaft 63 the upper and lower ends of which are rotatably supported by the frame 3 through bearings 65. A motor 67 is provided on the frame 3 to turn the support shaft 63 through torque transmission means 69 such as gears. In FIG. 3, the one of the punch changer arms 55 and one of the die changer arms 53 are positioned at the first punch and die exchange positions 61, respectively.

As best shown in FIG. 3, each punch changer arm 51 is provided at its free end with a vertical holder 71 for holding a punch set 57. Specifically, the holder 71 has a plate spring gripper 73 formed with a stopper 75 for engaging with a stopper groove 79 formed in the head 77 of the punch P. Thus, the punch set 57 is held by the plate spring gripper 73 thank to the elastic force thereof. Furthermore, a hydraulic cylinder 83 acting as a pusher 81 is provided on the free end of the changer arm 51. A disk 87 for abutting the head of the punch P is attached to the lower end of the piston rod 85 of the cylinder 83.

Similarly, a holder 71 for holding a die D, and a pusher 81 for pushing the die D downwardly are provided at the free end of each die changer arm 91. In particular, a stopper 75 formed in the plate spring gripper 73 of the holder 71 is adapted to removably engage with a stopper groove 89 formed in the die D.

Referring to FIG. 3, the upper turret 5 is provided with holes 91 for receiving the punch sets 57. The holes 91 is formed with a keyway 93 to which a key 97 formed on the side face of the punch guide 95 of the punch set 57 is fitted to prevent the punch set 57 from rotation.

In FIG. 3, the lower turret 7 is provided with a rotary die holder 99 of an automatic index station. The rotary die holder 99 is provided with a hole 101 having a keyway 103. A key formed on the side of the die D is fitted in the keyway 103 to prevent the die D from rotation. The rotary die holder 99 is also provided with a worm wheel on the side face thereof. The worm wheel is adapted to engage with a worm 109 of a torque transmission shaft 107 which is coupled to a motor (not shown) mounted on the lower turret 7. Thus, the angular position of the die D fitted to the die holder 99 is adjusted by the control of the motor on the lower turret 7.

As shown in FIG. 3, a turret table 111 for supporting the work W is provided with a hole 113 at a position just under the hole 91 of the upper turret 5; the diameter of the hole 113 is substantially the same as the hole 91 of the upper turret 5. The lower turret 7 is also provided with holes 115 at a radial position thereof which can vertically align with the hole 113 of the turret table 111 by rotation of the lower turret 7; the diameter of the hole 115 is substantially the same as that of the hole 113. A punch pusher 117 for pushing up the punch set 57 is disposed just under the holes 113 and 115. Specifically, the punch pusher 117 includes a hydraulic cylinder 119, and a piston rod 121 having a pusher disk 123 at its upper end. The pusher disk 123 is adapted to pass through the holes 115,118, and 91 for pushing up the punch set 57.

Similarly, a die pusher 125 for pushing up the die D is disposed just under the rotary die holder 99 in FIG. 3. The die pusher 125 includes a hydraulic cylinder 127, and a piston rod 129 having a pusher disk 131 at its the upper end. The pusher disk 131 is adapted to pass through a hole 133 provided in the rotary die holder 99 attached to the lower turret 7.

Thus, to remove the punch set 57 (with the punch P) and die D from the upper and lower turrets 5 and 7, the punch changer arm 51 and die changer arm 53 are first positioned at the respective first exchange positions 61 above the turrets 5, 9. Then, the cylinders 119 and 127 of the punch pusher 117 and die pusher 125 under the turret 5 and 7 are activated to protrude the piston rods 121 and 129 upwardly, so that the pusher disks 123 and 131 push up the punch set 57 and die D, respectively.

The pushed-up punch set 57 and die D are held by the plate spring grippers 73 attached to the changer arms 51 and 53. The support shaft 63 of the changer arms 51 and 53 is then turned through 180 degrees to locate the punch set 57 and die D at storage positions on the tool magazine 59, which will be described in detail in the following. Here, the piston rods 121 and 129 of the punch pusher 117 and die pusher 125 under the turrets 5 and 7 are retracted after the pushing up of the punch set 57 and die D.

Conversely, to install a new punch set 57 and die D on the upper and lower turret 5 and 7, the punch set 57 and die D are first picked up from the tool magazine 59 by the punch changer arm 51 and the die changer arm 53, respectively. The punch changer arm 51 and die changer arm 53 are then turned through 180 degree in order to locate the picked-up punch set 57 and die D at the first exchange positions 61 above the turrets 5, 7. The cylinders 83 of the pushers 81 of the arms 51, 53 are then activated to extend the piston rods 85 downwardly, so that the disks 87 push down the punch set 57 and die D. As a result, the punch set 57 and the die D are released from the plate spring grippers 73, and are inserted into the hole 91 of the upper turret 5 and the hole 101 of the rotary die holder 99, respectively.

Referring again to FIGS. 1 and 2, the tool magazine 59 includes a small punch disk 137 and a large die disk 139 each adapted to store punch sets 57 or dies D. The small punch disk and the large die disk 137, 139 are mounted on the support shaft 135 rotatably supported by the frame 3. By rotating the disks 137, 139, a required punch set 57 and a corresponding die D on the disks 137, 139 are moved to respective second exchange positions 141 where the punch sets 57 and dies D are exchanged between the tool magazine and the tool changer 55.

Specifically, the upper and lower ends of the support shaft 135 are rotatably supported by the frame 3 through bearings 143. A motor 145 is provided on the frame 3 to turn the support shaft 135 through torque transmission members 147 such as gears. The motor 145 is controlled to bring the disks 137 and 139 to the respective second exchange positions 141. Similarly, the motors 67 for the tool changer 55 is controlled to bring the changer arms 51 and 53 to the respective first exchange positions 61 above the turrets 5, 7.

Disposed at the second exchange positions 141 are cylinders 119 and 127 identical to those of the punch pusher 117 and die pusher 12S at the first exchange positions 61. The punch disk 137 and die disk 139 of the tool magazine are provided with holes 149,151 at a radial positions corresponding to the cylinders 119 and 127, for storing punch sets 57 and dies D, respectively. The die disk 139 is also provided with holes 153 through which a pusher disk 131 provided on the piston rod 129 of the cylinder 127 can freely pass. Just under the holes 149 of the punch disk 137, the die disk 139 is further provided with holes 155 through which a pusher disk 123 provided on the piston rod 121 of the cylinder 119 can Freely pass.

With this arrangement, when the motor 145 is driven to turn the disks 137 and 139 through the transmission members 147 and support shaft 135, a required punch set 57 and a corresponding die D on the disks 137 and 139 are moved to the respective second exchange positions 141. The cylinder 119 and the cylinder 127 at the second exchange position 141 are then activated to push the piston rods 121, 129 upwardly, so that the pusher disks 123 and 131 push up the punch set 57 and die D, respectively. The punch set 57 and die D are thus moved upwardly and held by the plate spring grippers 73 of the holders 71 on the punch and die changer arms 51, 53, respectively.

Conversely, the punch set 57 and die D held by the punch and die changer arms 51, 53 can be transferred to and stored in the punch and die disks 137, 139 by means of the pushers 81 on the arms 51, 53. The manners in which the punch set 57 and die D on the arms 51, 53 are transferred to and stored in the punch and die disks 137 and 139 are the same as that in which the punch set 57 and die D on the arms 51, 53 are transferred to and set on the upper and lower turrets 5 and 7, and therefore the detailed description thereof is omitted.

The operations of the punch and die changer 49 as a whole will be described. The upper and lower turrets 5 and 7 are turned to bring a punch set 57 and a corresponding die D, which is to be exchanged, to the respective first exchange positions 61. On the other hand, the punch and die disks 137, 139 are turned so that a new punch set 57 and a corresponding die D are positioned at the respective second exchange positions 141. Then, the opposite changer arms 51 and 53 of the tool changer 55 are turned so that the free ends thereof are positioned at the first and second exchange positions 61,141, respectively.

The cylinders 119 and 127 of the pushers 117 and 125 at the first exchange positions 61 are then activated to push up the punch set 57 and die D from the turrets 5 and 7. The removed punch set 57 and die D are respectively held by the plate spring grippers 73 of the punch and die changer arms 51 and 53. The pushers 117 and 125 at the first exchange positions are then retracted to their original positions. The cylinders 119 and 127 of the pushers 117 and 125 at the second exchange positions 141 are also activated to push up the new punch set 57 and die D from the punch and die disks 137, 139. The new punch set 57 and die D are then held by the plate spring grippers 73 of the other changer arms 51 and 53. The pushers 117 and 125 at the second exchanging positions 141 are retracted into their original positions.

Subsequently, the changer arms 51 and 53 are turned through 180 degrees so that the new punch set 57 and die D are positioned at the first exchange positions 61, and the punch set 57 and die D removed from the turrets 5, 7 are positioned at the second exchange positions 141.

At this time, the cylinders 83 of the pushers 81 of the punch changer arm 51 and die changer arm 53 are activated, so that the disks 87 of the pushers 81 on the punch and die exchanger arms 51, 53 push downwardly the head 77 of the punch P and the die D, respectively. Thus, the punch set 57 and die D are disengaged from the plate spring grippers 73 of the holders 71, and are inserted into the hole 91 of the upper turret 5 and the hole 101 of the rotary die holder 99 on the lower turret 7, respectively. This completes the setting of the new punch set 57 and die D onto the upper and lower turrets 5 and 7.

Similarly, the punch set 57 and die D removed from the turrets 5, 7 are stored in a holes 149 and 151 of the punch disk 137 and the die disk 139, respectively.

As described above, each die D is exchangeable from above the lower turret. This improves workability, solves the space problem in designing dies, expands a storage space for dies, and realizes an automatic exchange of dies for an automatic index station. Here, it is to be noted that in order to identify dies to be exchanged, a noncontact type ID chip, which is generally used for data communication, may be employed.

Figure 4:
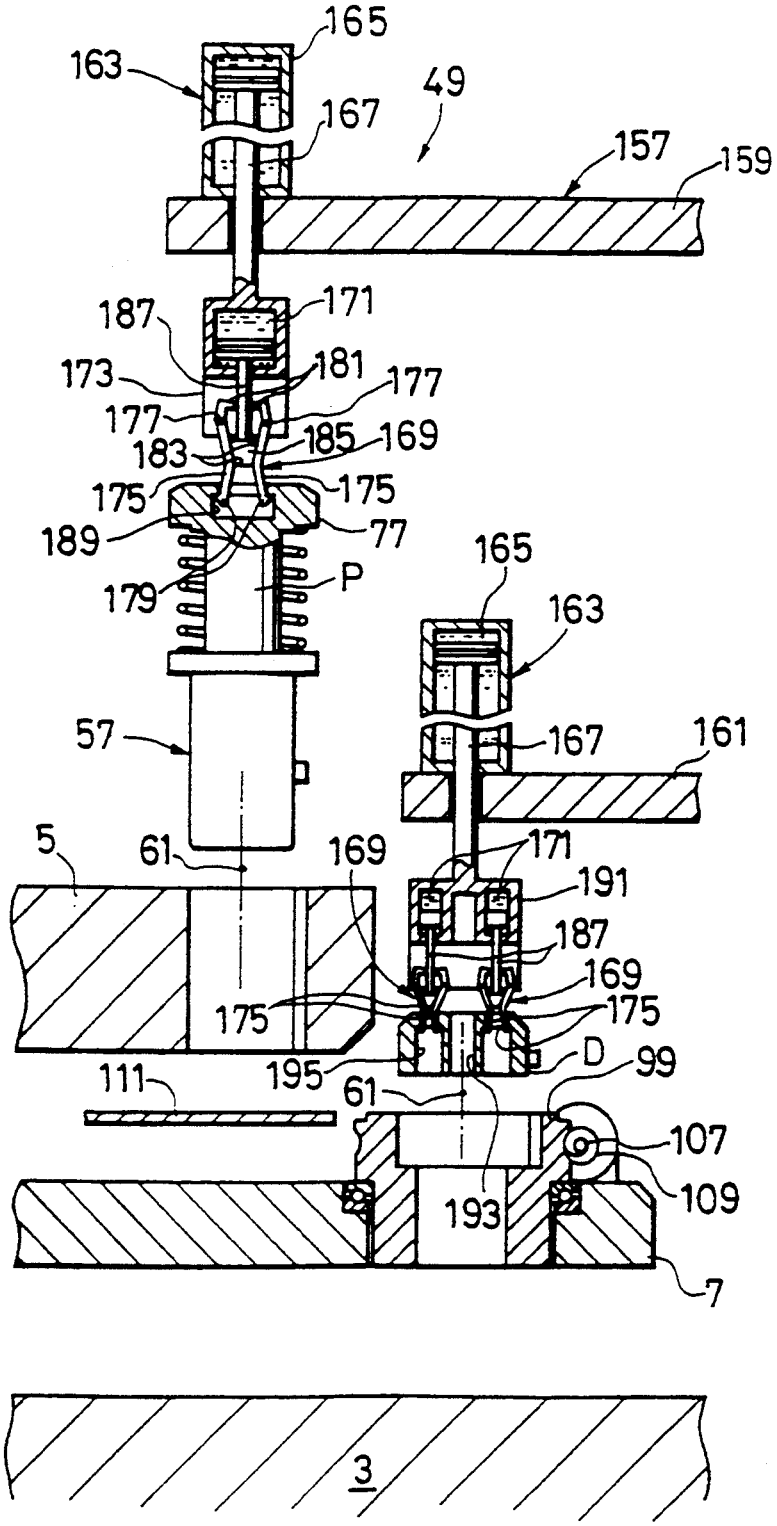
FIG. 4 is an enlarged side section showing another tool changer provided in the first embodiment of the turret punch press.

FIG. 4 shows another embodiment of the tool changer 55 of the punch and die changer 49. The same parts as those of the above embodiment are represented with like reference marks, and their detailed explanations are omitted.

The tool changer 157 has a support shaft 63 as shown in FIG. 1. A pair of long punch changer arms 159 and the pair of short die changer arms 161 are also adapted to protrude from the support shaft 63 in opposite directions, respectively, while each punch changer arm 159 and die changer arm 161 of each pair extending in parallel with each other.

As shown in FIG. 4, each punch changer arm 159 is provided with a vertical moving means 163 at its free end. The vertical moving means 163 includes a hydraulic cylinder 165 having a piston rod 167. The piston rod 167 is provided at its lower end with a block 173 having a chuck 169 for holding the punch P and a hydraulic cylinder 171 for operating the chuck 169. The chuck 169 includes a pair of claws 175 pivotally mounted on the block 173 by pins 177. The claws 175 are provided at their lower end with projections 179 protruding outwardly, and at their upper end with projections 181 protruding inwardly, and at their inner sides of the approximate midpoints with tapered faces 183. The projections 179 of the claws 175 are adapted to engage with a stepped hole 189 provided in the head 77 of a punch P. In order to operate the claws 175, the piston rod 187 of the cylinder 171 is provided at its lower end a triangle pusher 185 adapted to engage with the tapered faces 183 and the upper projections 181 of the claws 175.

Thus, when the cylinder 171 is activated to extend the piston rod 187 downwardly, the triangle pusher 185 provided at the lower end of the piston rod 187 pushes the tapered faces 183 of the claws 175, so that the lower ends of the claws 175 are opened. As a result, lower the projections 179 engage with the stepped hole 189 of the head 77 of the punch P, thereby the punch P being held by the chuck 169.

On the other hand, when the cylinder 171 is activated to retract the piston rod 187 thereinto, the pusher 185 pushes the upper projections 181 upwardly and outwardly, so that the lower ends of the claws 175 are closed. As a result, the lower projections 179 is disengaged from the stepped hole 189 of the punch P, thereby the punch P being disengaged from the chuck 169.

Similar vertical moving means 163 is provided at the free end of each die changer arm 161. This vertical moving means 163 also includes a hydraulic cylinder 165 having a piston rod 167. The piston rod 167 is provided at its lower end with a block 191 having a pair of chucks 169 for holding a die D and a hydraulic cylinders 171 for actuating the pair of chucks 169. Each chuck 169 of the die changer arm 161 is similar to the chuck 169 of the punch changer arm 169. That is, the claws 175 of the chucks 169 is adapted to engage with stepped hole 195 provided in the die D. In FIG. 4, the punch set 57 and die D are in their pulled-up states.

The operation of the arrangement of FIG. 4 as a whole will be explained.

The upper and lower turrets 5 and 7 are turned to bring a punch set 57 (with a punch P) and a corresponding die D, which is to be exchanged, to the respective first exchange positions 61 (FIG. 1). The chucks 169 of the changer arms 159 and 161 are then located above the punch set 57 and die D on the turrets 5, 7. Here, the piston rods 187 for the chucks 169 are retracted into the cylinders 171 so that the lower ends of the claws 175 are closed. The cylinders 165 of the vertical moving means 163 are then extended downwardly so that the projections 179 of the claws 175 are inserted into the stepped hole 189 of the head 77 of the punch P and into the stepped holes 195 of the die D, respectively.

The cylinders 171 are subsequently activated to extend the piston rods 189 downwardly so that the pushers 185 open the lower ends of the claws 175 to hold punch P and die D. The cylinders 165 of the vertical moving means 163 are then activated to pull the punch set 57 and die D out of the upper and lower turrets 5 and 7. Next, the changer arms 159 and 161 are turned through 180 degrees so that the punch set 57 and die D can be stored in the tool magazine 59.

These operations may be reversely carried out to transfer a new punch set 57 and a corresponding die D for the next process from the tool magazine 59 to the upper and lower turrets 5 and 7.

The embodiment of the tool changer as shown in FIG. 4 includes no means corresponding to the cylinders 119 and 127 under the turrets 5, 7 and the disks 137, 139 as shown in FIGS. 1 and 3. Thus, in the embodiment as shown in FIG. 4, the number of parts are reduced compared with the first embodiment of the tool changer while providing the same effect.

With respect to the automatic index mechanism as shown in FIGS. 3 and 4, the following should be noted. That is, in FIGS. 3 and 4, the automatic index mechanism is provided only on the die D. In an actual turret punch press, however, a suitable automatic index mechanism is also provided on a punch set 57 corresponding to the die on which the automatic index mechanism is provided.

Figure 5:
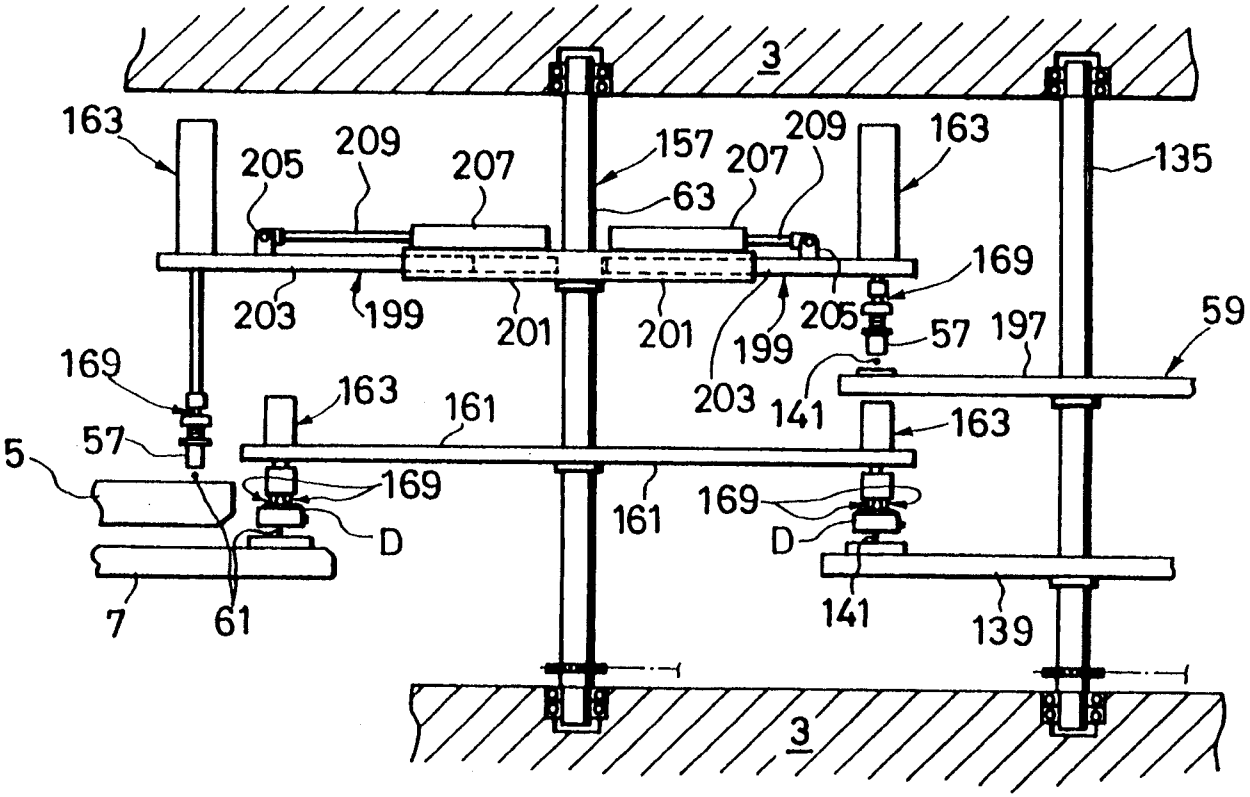
FIG. 5 is a side view showing still another tool changer and a tool magazine provided in the first embodiment of the turret punch press.

FIG. 5 shows still another embodiment of the tool changer 55 and the tool magazine 59. The same parts as those of the previous embodiments are represented with like reference marks and their detailed explanations are omitted.

In this embodiment, a punch disk 197 disposed above a die disk 139 has the same diameter as that of the die disk 139.

A die changer arm 161 of the tool changer 157 is the same as the die changer arm of the previous embodiments as shown FIGS. 1–3. On the other hand, a punch changer arm 199 disposed above the die changer arm 161 is extendable and retractable. That is, the punch changer arm 199 includes a pair of arm bodies 201 protruding from a support shaft 63 in the opposite directions. Shafts 203 are slidably mounted on the respective arm bodies 201 for sliding along the longitudinal directions of the arm bodies 201. Attached to the vicinities of the free ends of the shafts 203 are brackets 205 each connected to each of piston rods 209 of hydraulic cylinders 207 mounted on the respective arm bodies 201. The shafts 203 are also provided at their free ends with the vertical moving means 163 and the chucks 169 as shown in FIG. 3.

In this embodiment, to attach a punch set 57 to and detach the same from the upper turret 5, the cylinder 207 is activated to protrude the piston rod 209 outwardly so as to position the chuck 169 at the first punch exchange position 61. On the other hand, to attach the punch set 57 to and detach the same from the punch disk 197 of the tool magazine 59, the cylinder 207 is activated to retract the piston rod 209 inwardly so as to position the chuck 169 at the second punch exchange position 141. The manner in which the punch set 57 and die D are exchanged is the same as that of the previous embodiment as shown in FIG. 4.

In this way, even if the die disk 139 and punch disk 197 of the tool magazine 59 have the same diameter, punches P and dies D can be easily exchanged.

Figure 6:
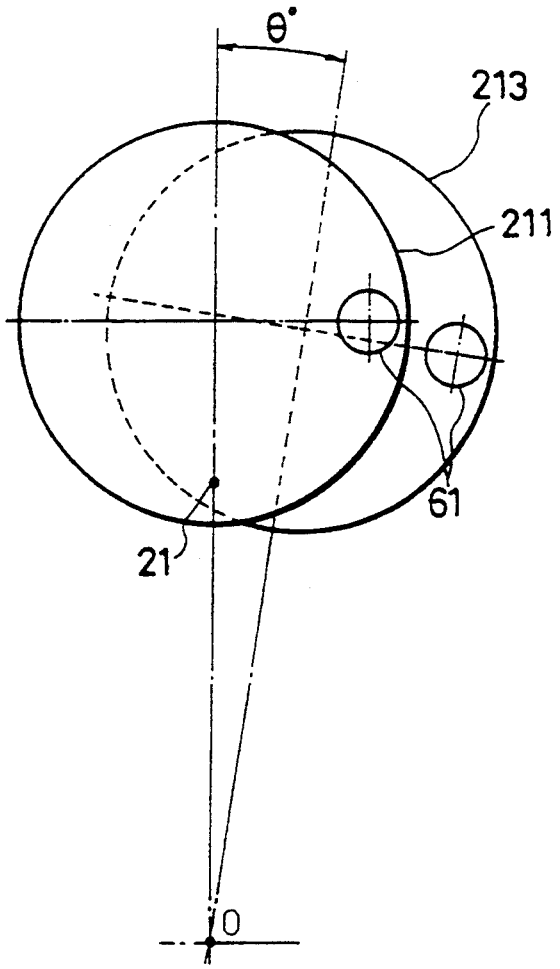
FIGS. 6 and 7 is schematic views showing operations of the turrets provided in the second embodiment of the turret punch press.
Figure 7:
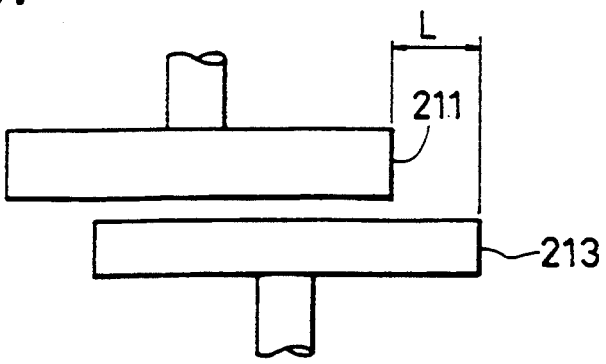

FIGS. 6 and 7 schematically show the operation of turrets 9 according to the second embodiment of the present invention. The turrets 9 includes an upper turret 211 and a lower turret 213 one of which is adapted to be movable relative to the other around a center 0. In FIG. 6, the upper turret 211 is displaced through the angle of $\theta$ relative to the lower turret 213 which is fixed. However, a lower turret 213 may alternatively be adapted to be movable relative to a upper turret 211.

As shown in FIG. 7, the movement of the upper turret 211 relative to the lower turret 213 through angle of $\theta$ creates a horizontal positional difference L between the upper turret 211 and lower turret 213. Thanks to this horizontal positional difference L, a die D can be exchanged from above the lower turret 213.

Figure 8:
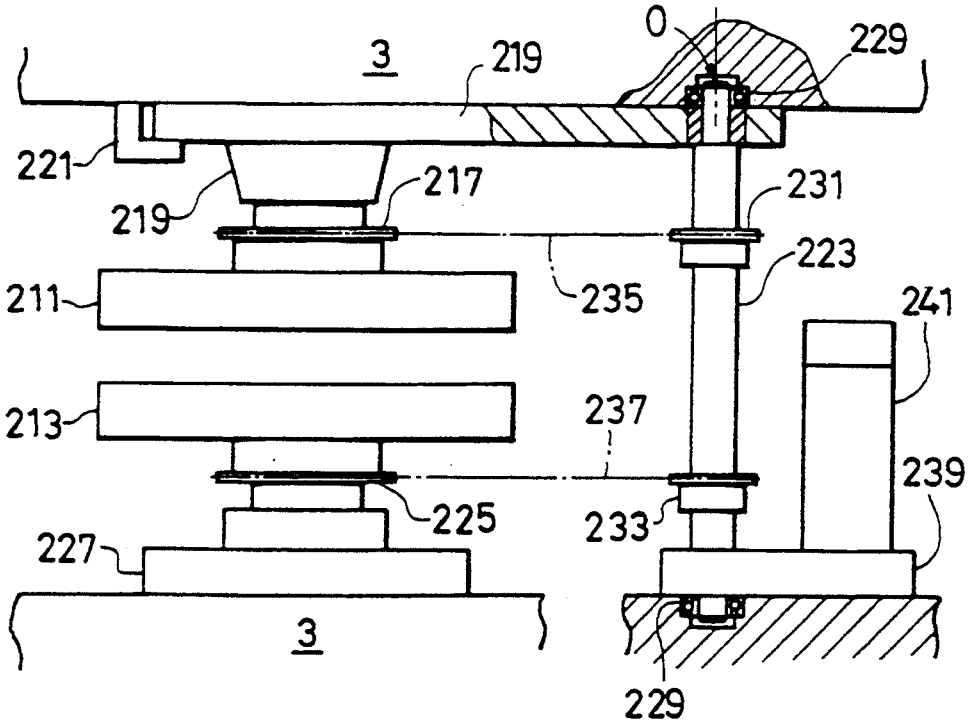
FIG. 8 is a side view showing an essential section of the second embodiment of the turret punch press.
Figure 9:
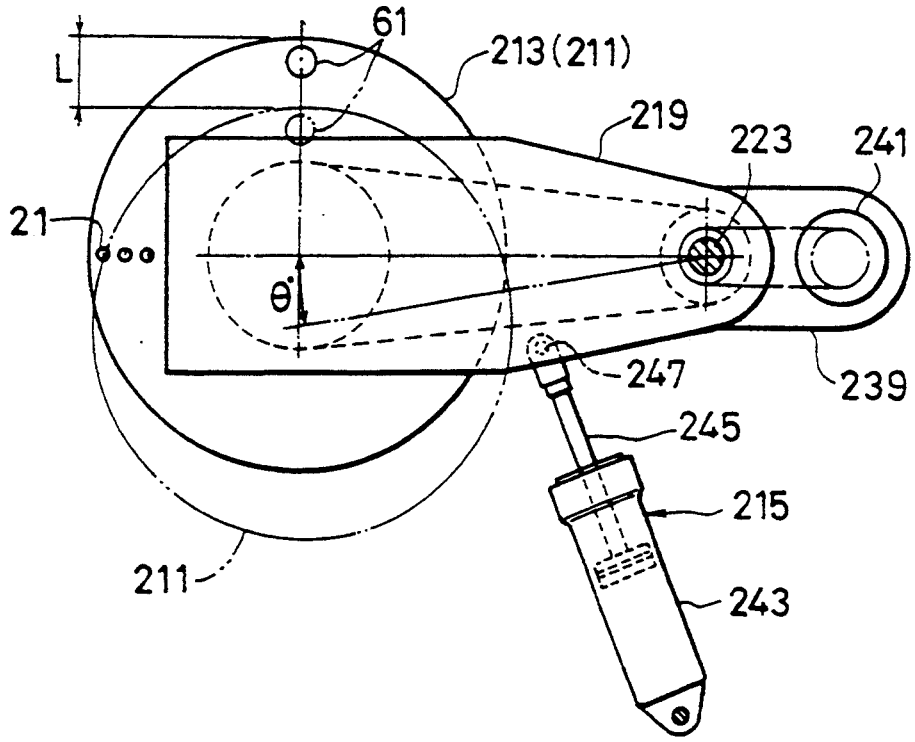
FIG. 9 is a plan view of the essential section shown in FIG. 8.

FIGS. 8 and 9 show a specific arrangement for moving the upper turret 211 relative to the lower turret 213. In this arrangement, the lower turret 218 is fixed and the upper turret 211 is swung around the center 0.

As best shown in FIG. 8, the upper turret 211 is rotatably supported by an upper base 219 which is in turn pivotally supported by a drive shaft 223 provided at a pivot 0 corresponding to the center 0 of FIG. 6. Accordingly, the upper turret 211 is movable around the center 0. The upper base 219 is normally fixed to the frame 3 by a clamp mechanism 221 which is of a known arrangement employing, for example, a hydraulic cylinder. Accordingly, the upper turret 211 is normally fixed in a suitable angler position around the pivot 0. On the other hand, the lower turret 213 is rotatably supported by a lower base 227 which is fixed to the frame 3.

In order to rotate the upper and lower turrets 211 and 213 relative to the upper and lower bases 219 and 227, the drive shaft 223 is pivotally supported by the frame 3 at a pivot 0 through upper and lower bearings 229. In addition, an upper chain 235 is stretched around the an upper driven sprocket 217 on the upper turret 211 and an upper driving sprocket 231 on the drive shaft 223, and a lower chain 237 is stretched around a lower driven sprockets 225 and a lower driving sprocket 233. The lower end of the drive shaft 223 is connected to a motor 241 through a torque transmission members 239 such as gears. Accordingly, the upper and lower turrets 211 and 213 are driven in synchronization by motor 241.

FIG. 9 shows the details of means 215 for pivoting the base frame 219 about the pivot 0 or the shaft 223. The moving means 215 includes a hydraulic cylinder 243 which is supported by the frame 3 at its proximal end. The free end of the piston rod 245 of the cylinder 243 is pivotally fitted to the upper base 219 with a pin 247.

With this arrangement, while a punching is being performed in a workpiece at the punching position 21, the upper turret 211 is fixed relative to the frame 3 by means of the clamp mechanism 221, so that the lower turrets 211 and 213 are vertically aligned during the punching operation. To exchange a punch P and die D, the clamp mechanism 221 is released, and the cylinder 243 is activated to retract the piston rod 245 thereinto. As a result, the upper turret 211 supported by the upper base 219 is turned, through the angle of $\theta$, to a tool exchange position illustrated by the two-dot chain line in FIG. 9. In this way, the horizontal positional difference L is created between the upper and lower turrets 211, 213, so that the die D can be exchanged from above the upper turret 213. The punch P and die D on the turrets 211, 213 will then be exchanged with others by the punch and die changer 49 which was described in connection with the first embodiment of the present invention shown in FIGS. 1–3. Thus, the second embodiment of the present invention also provides the same effect as the first embodiment as shown in FIGS. 1–3.

Figure 10:
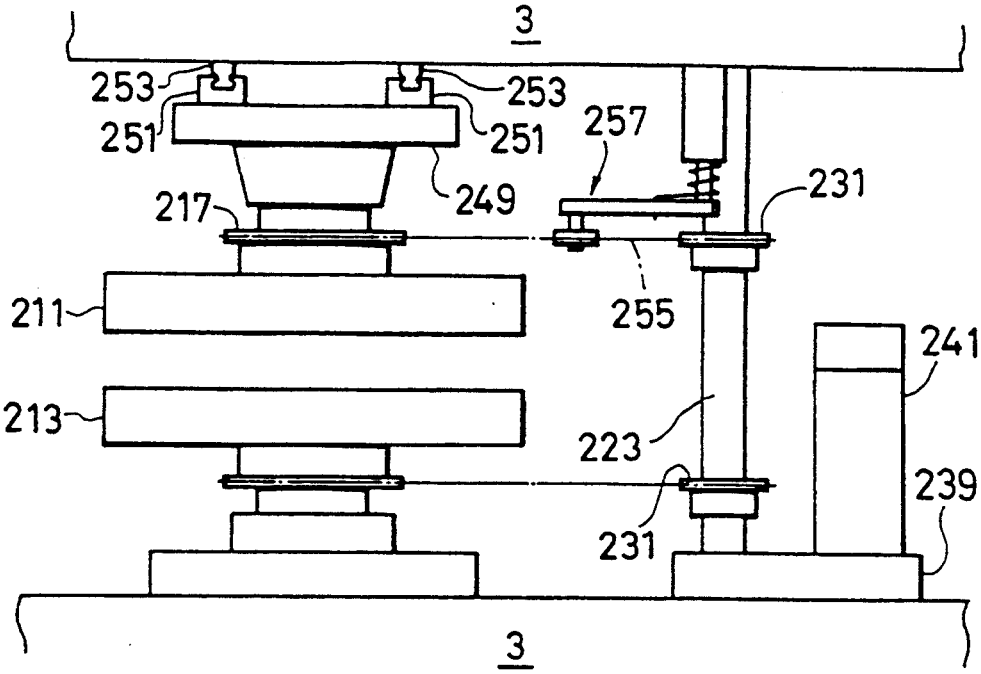
FIG. 10 is a side view showing an essential section of the third embodiment of the turret punch press.
Figure 11:
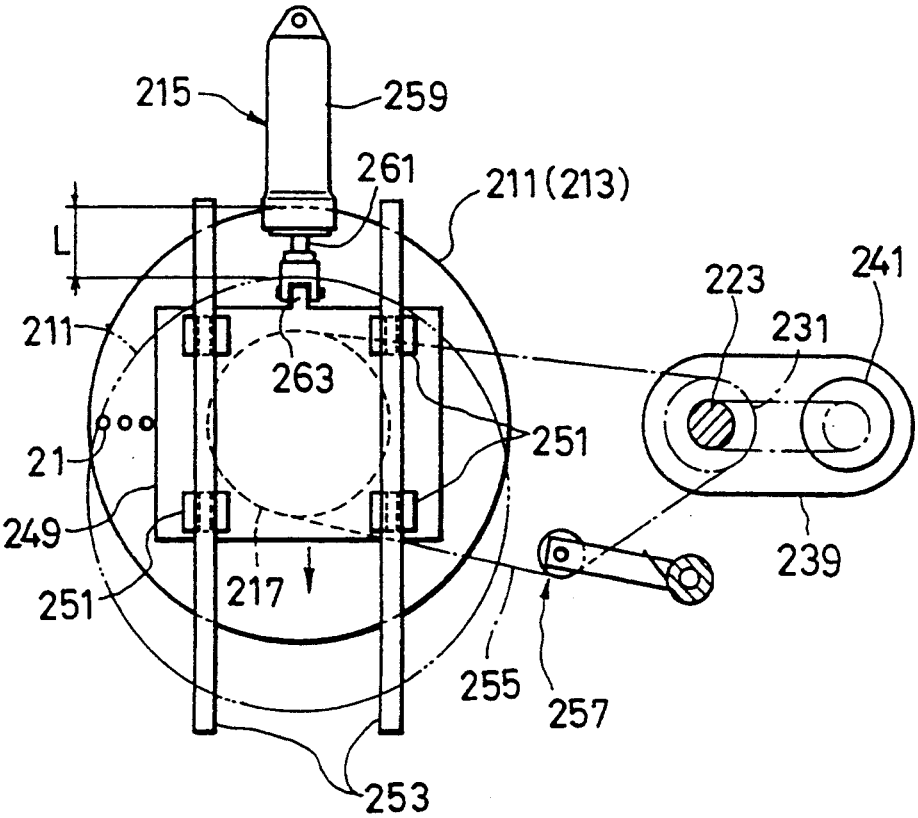
FIG. 11 is a plan view of the essential section shown in FIG. 10.

FIGS. 10 and 11 show the third embodiment of the present invention including a slide type moving means 215. In this embodiment, the upper turret 211 is lineally slidable relative to the lower turret 213.

As best shown in FIG. 10, the upper turret 211 is rotatably supported by an upper base 249 which is provided with a pair of linear guides 251 at its upper face. The pair of linear guide 251 slidably engage with respective rails 253 fixed on the frame 3. Accordingly, the upper turret 211 is lineally slidable in the direction perpendicular to the plane of FIG. 10. A mechanism for rotating the upper turret 211 is similar to that of the embodiment in FIG. 8. What is different from the embodiment in FIG. 8 is that a chain tensioner 257 is provided for a chain 255 stretched around an upper sprocket 217 on the upper turret 5 and an upper sprocket 231 on the drive shaft 223.

FIG. 11 shows the details of means 215 for moving the upper base 249 along the rails 253. The moving means 215 includes a hydraulic cylinder 259 supported by the frame 3 at its proximal end. The free end of the piston rod 261 of the cylinder 259 is connected to a bracket 263 formed at a side of the upper base 249.

In operation, while a punching is being performed in a workpiece, the upper and lower turrets 211 and 213 are vertically aligned by the clamp mechanism 221 (not shown in FIG. 10) of the second embodiment of the present invention. To exchange a punch P and die D, the clamp mechanism is released, and the cylinder 259 is activated to protrude the piston rod 261 outwardly. Then, the upper base 249 slides along the rails 253 through the distance L to be located at a tool exchange position indicated by a two-dot chain line in FIG. 11. In this way, the upper and lower turrets 211 and 213 is horizontally displaced from each other through the distance L, so that the die D can be exchanged from above the lower turret. As mentioned above in connection with the second embodiment of the present invention, the punch P and die D on the turrets 211, 213 will then be exchanged with others by the punch and die changer 49 as shown in FIGS. 1–3. In this way, this embodiment also provides the same effect as the first embodiment.

In the third embodiment, the lower turret 213 is fixed while the upper turret 211 is slidable relative to the lower turret 213. However, it is also possible to fix the upper turret 211 and make the lower turret 213 slidable.

The present invention is not limited to the embodiments mentioned above and may be changed and modified without departing from the spirit thereof. For example, the hydraulic cylinders employed by the embodiments may be substituted by racks and pinions driven by motors. Similarly, the electric motor driven parts of the embodiments may be substituted by hydraulic cylinders.

In summary, a turret punch press according to the present invention has upper and lower turrets that are displaced from each other to enable a die to be exchanged from above the lower turret, thus eliminating the space problem in attaching dies to and detaching the same from the lower turret.

The present invention enables punches and dies to be exchanged from above the lower turret, thereby improving workability, expanding the freedom of designing of dies, providing a wide space for exchanging dies, and realizing an automatic exchange of dies in an automatic index station.

What is claimed is:

1. A turret punch press comprising: an upper rotary turret for holding punches and a lower rotary turret for holding dies, the diameter of the lower turret being larger than that of the upper turret so that a punch exchange position and a die exchange position are separated away from each other.

2. The turret punch press of claim 1, wherein the punch exchange position and the die exchange position are located across the centers of the turrets from a punching position where punching operation is performed.

3. The turret punch press according to claim 2, further comprising a punch and die changer adapted to be positioned above the punch and die exchange positions of the upper and lower turrets.

4. The turret punch press according to claim 3, wherein the punch and die changer includes:

a tool changer disposed adjacent to the punch and die exchange positions of the upper and lower turrets, the tool changer having punch and die changer arms;

pushers disposed just below the punch and die exchange positions of the upper and lower turrets, for pushing the punch and die upwardly; and a tool magazine disposed adjacent to the tool changer.

5. The turret punch press according to claim 4, wherein the tool magazine includes an upper punch disk and a lower die disk, the diameter of the die disk being larger than that of the punch disk.

6. The turret punch press according to claim 4, wherein at least one of the punch and die changer arms is extendable and retractable.

7. A turret punch press comprising: an upper rotary turret for holding punches and a lower rotary turret for holding dies, the upper and lower turrets being horizontally movable to separate a punch exchange position away from a die exchange position, wherein at least one of the upper and lower turrets is rotatably mounted on a pivotal frame which is pivotally mounted on a shaft.

8. The turret punch press of claim 7, wherein the upper and lower turrets substantially have the same diameter.

9. The turret punch press according to claim 7, further comprising a punch and die changer adapted to be positioned above the punch and die exchange positions of the upper and lower turrets.

10. The turret punch press according to claim 9, wherein the punch and die changer includes:

a tool changer disposed adjacent to the punch and die exchange positions of the upper and lower turrets, the tool changer having punch and die changer arms;

pushers disposed just below the punch and die exchange positions of the upper and lower turrets, for pushing the punch and die upwardly; and a tool magazine disposed adjacent to the tool changer.

11. The turret punch press according to claim 10, wherein the tool magazine includes an upper punch disk and a lower die disk, the diameter of the die disk being larger than that of the punch disk.

12. The turret punch press according to claim 10, wherein at least one of the punch and die changer arm is extendable and retractable.

13. A turret punch press comprising: an upper rotatory turret for holding punches and a lower rotatory turret for holding dies, the upper and lower turrets being horizontally movable to separate a punch exchange position away from a die exchange position, wherein at least one of the upper and lower turrets is rotatably mounted on a slide base which is supported on a frame so as to be slidable along a linear axis.

14. The turret press of claim 13, wherein the upper and lower turrets substantially have the same diameter.

15. The turret punch press according to claim 13, further comprising a punch and die changer adapted to be positioned above the punch and die exchange positions of the upper and lower turrets.

16. The turret punch press according to claim 15, wherein the punch and die changer includes:

a tool changer disposed adjacent to the punch and die exchange positions of the upper and lower turrets, the tool changer having punch and die changer arms;

pushers disposed just below the punch and die exchange positions of the upper and lower turrets, for pushing the punch and die upwardly; and a tool magazine disposed adjacent to the tool changer.

17. The turret punch press according to claim 16, wherein the tool magazine includes an upper punch disk and a lower die disk, the diameter of the die disk being larger than that of the punch disk.

18. The turret punch press according to claim 16, wherein at least one of the punch and die changer arms is extendable and retractable.

* * * * *